US005568159A

United States Patent [19]

Pelton et al.

[11] Patent Number: 5,568,159

[45] Date of Patent: Oct. 22, 1996

[54] FLARED NOTCH SLOT ANTENNA

[75] Inventors: Edward L. Pelton, San Diego; John R. Glabe, Ramona, both of Calif.

[73] Assignee: McDonnell Douglas Corporation, Huntington Beach, Calif.

[21] Appl. No.: 403,404

[22] Filed: Mar. 14, 1995

Related U.S. Application Data

[63] Continuation-in-part of Ser. No. 241,565, May 12, 1994, abandoned.

[51] Int. Cl.[6] ..... H01Q 13/18

[52] U.S. Cl. ..... 343/767; 343/770; 343/789

[58] Field of Search ..... 343/767, 789, 343/705, 770; H01Q 13/00, 13/10, 13/18

[56] References Cited

U.S. PATENT DOCUMENTS 4,006,481 2/1977 Young et al. ..... 343/767

4,843,403 6/1989 Lalezari et al. ..... 343/767

4,978,965 12/1990 Mohuchy ..... 343/767

5,229,777 7/1993 Doyle ..... 343/770

*Primary Examiner*—Michael C. Wimer

*Attorney, Agent, or Firm*—George J. Netter; John P. Scholl

[57] ABSTRACT

An antenna (10) is provided by a metal layer (12) deposited on a dielectric substrate (16) which is etched to form a pair of symmetrical slot sections (20,22) having facing edges which increasingly curve away from each other to a maximum spacing point which is the antenna aperture (26). A linking slot (32) interconnects the slot sections (20,22) at a feed point (30) spaced from the aperture (26). High frequency electrical voltage applied at the feed point (30) achieves launch of an electromagnetic wave from the aperture (26). An alternative feed network uses a 180° hybrid (60) providing simultaneous horizontal and vertical polarization operation.

11 Claims, 3 Drawing Sheets

Magnitude dB vs Azimuth

FLARED NOTCH SLOT ANTENNA

This is a continuation-in-part of U.S. patent application Ser. No. 08/241,565 filed May 12, 1994, now abandoned.

FIELD OF THE INVENTION

The present invention relates generally to a non-resonant antenna, and, more particularly, to such an antenna with flared notch slot elements exhibiting a broad operating bandwidth and capable of providing either directive or omni-directional radiation.

DESCRIPTION OF RELATED ART

A typical farm of microwave antenna utilizing circuit board techniques for construction includes first and second electrodes laid down on a common surface of an insulative substrate, which electrodes have tapering facing portions to provide a continuously increasing spacing between the electrodes until a maximum is reached at the forwardmost end. When used in the transmission mode, electrical energy is applied at the closely spaced end and the electromagnetic signal is launched from the opposite end in what is termed an end-fire manner. The polarization of the launched signal is typically linear, with the polarization parallel to the plane of the electrodes. Such antennas have wide application and are especially advantageous where a large number of individual antennas are arranged in an array for ultimate use. One example of an antenna of this general category is that disclosed in U.S. Pat. No. 3,947,850.

SUMMARY OF THE INVENTION

In the practice of the present invention, the antenna is fabricated by first depositing a metallic layer onto a surface of an insulative substrate. The metal layer is etched away to form a shaped slot having a pair of spaced apart slot sections which extend from a narrowly spaced first end along a substantially parallel transition portion and then along continuously curved and widening slot section edges to a maximum spacing at the opposite end. The maximum non-parallel, separated slot section ends form the antenna radiating aperture in transmission mode and include a furtherance of the shaped slot sections extending from the wide ends of the slot sections to form a termination. The termination slots are covered with a thin layer of a lossy material to absorb electromagnetic energy not radiated from the aperture.

Because of the general aspects of the slot construction (i.e., relatively thin), the antenna lends itself to readily being applied to a conformal use, in that it can be located completely within the wall of a cavity on the exterior surface of an aircraft, for example, and still provide optimal operation. When so mounted, the cavity is preferably lined with an absorbing material to prevent undesirable re-radiation of inwardly directed radiation.

The described antenna is especially advantageous in providing an extremely broad operating bandwidth for a slot type radiator (e.g., 600% bandwidth has been demonstrated). Also, increased gain and either omnidirectional or directive operation may be obtained as well as conformal mounting already mentioned. The polarization of the radiated signal is linear and perpendicular to the conductive surface containing the slot.

In an alternative version of feed network for the described antenna, a 180° hybrid with sum and difference ports enables the provision of simultaneous horizontally polarized and vertically polarized signals.

DESCRIPTION OF A PREFERRED EMBODIMENT

Figure 1:
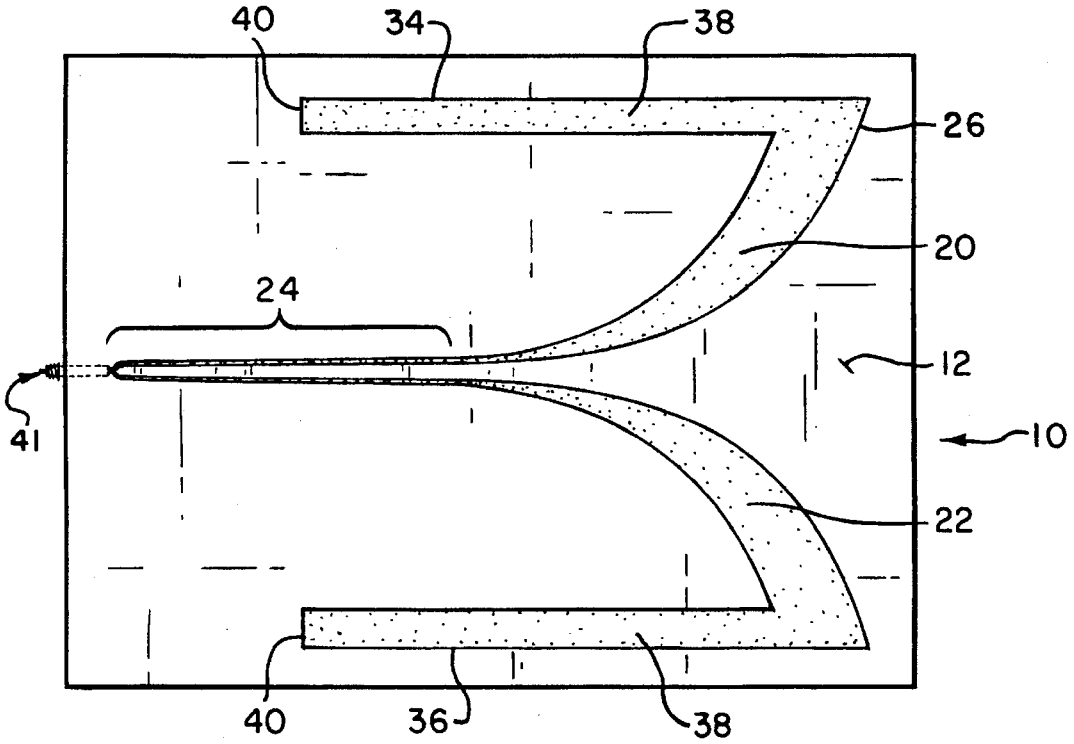
FIG. 1 is a top plan view of the antenna of the present invention.

Turning now to the drawings, the invention to be described is enumerated as 10 and in its general constructional aspects is a nonresonant slot antenna. Constructionally, the antenna 10 to be described is formed from a relatively thin metal layer 12 (e.g., copper) deposited on a major surface 14 of an electrically insulative substrate 16. Satisfactory materials for making) the substrate 14 and the techniques involved in depositing the metal layer 12 onto the substrate can be those typically utilized in the making of so-called circuit boards.

Figure 5:
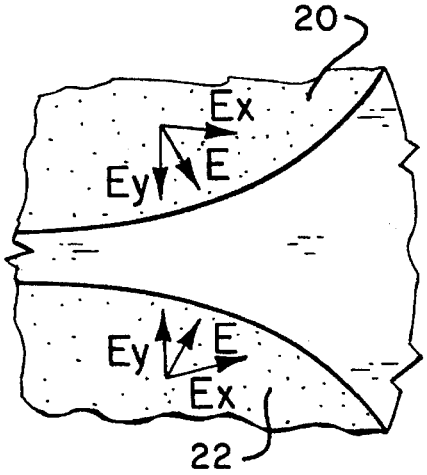
FIG. 5 is an enlarged, partially fragmentary plan view of the antenna slot sections of FIG. 1.

With reference particularly to FIGS. 1 and 5, it is seen the metal layer 12 has been etched away to leave first and second slot sections 20 and 22. More particularly, each slot section includes a transition portion 24 where the slot width is very narrow and the two transition portions are substantially parallel in slightly spaced apart relation. On moving forwardly of the transition portion toward what is the electromagnetic energy launching end or aperture 26, the lateral metal edges of the two slot sections are continuously curved away from each other to substantially increase each slot section width to a maximum at the aperture while at the same time separating the two slot sections by an increasing extent of intervening metal layer. As will be more particularly described, the two symmetrical slot sections 20 and 22 serve as the two antenna elements that form the slot antenna of this invention.

Figure 3:
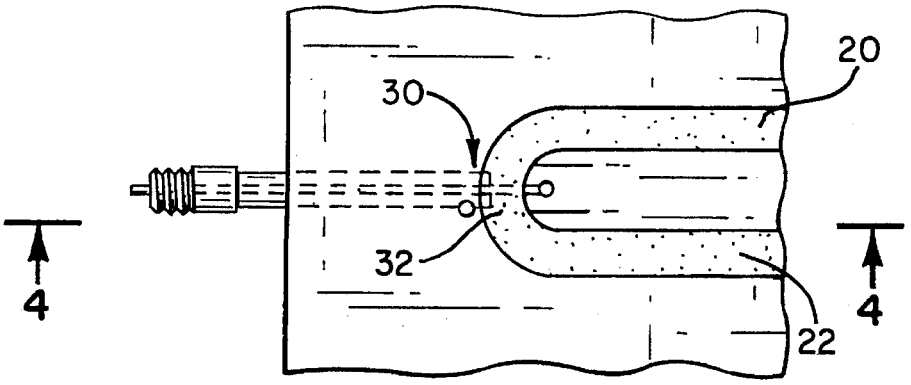
FIG. 3 is an enlarged detailed view showing the antenna feed point.

Reference is now made to the enlarged view of that part of the antenna slot shown in FIG. 3 which is the feed point 30 for the antenna (i.e., where electrical energy is applied during transmission mode or where processing equipment is connected in the reception mode). It is to be noted that the outer ends of the two slot transition portion 24 are joined by a linking slot 32, so that the slot sections and linking slot actually form a single slot with all of the various slot parts in communication with each other.

Returning once again to FIG. 1, the outer ends of the slot sections at the aperture 26 are seen to include slot portions extending rearwardly generally parallel to each other and to the slot transition 24 forming terminations 34 and 36 for the antenna. The specific termination configuration shown was selected primarily to minimize the overall aperture dimensions, but otherwise the termination portions may extend generally outwardly other than in the depicted parallel directions and still provide satisfactory antenna operation. By use of a resistive spray, for example, a tapered resistance 38 is provided along each termination which is in the range of 1000 ohms at the aperture to very nearly 0 ohms at the termination end 40 for absorbing signals not radiated at the aperture.

Figure 4:
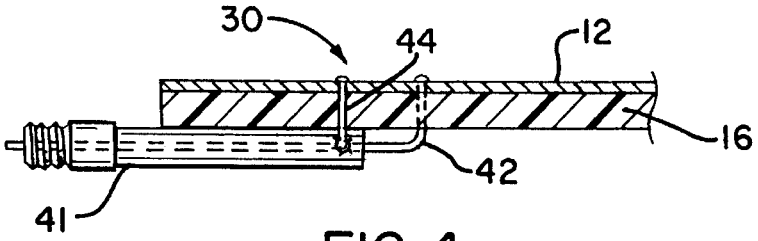
FIG. 4 is a side elevational view of FIG. 3 taken along the line 4—4.

In transmission use, the electrical energy is applied to the feed point 30 via, say, a coaxial cable 41 (FIGS. 1 and 4) with the center conductor 42 and outer shield conductor 44, after passing through openings in the dielectric substrate, being connected to the metal layer 12 at points on opposite sides of the linking slot 32. There is little or no radiation in the closely spaced parallel slot portions in the transition region 24 due to counter-phasing of the parallel slot fields, so the signal propagates in a forward direction toward the aperture. As the slot sections 20 and 22 become more non-parallel, the transverse component E of the slot field become additive (i.e., in phase) and as a result radiation is initiated in these portions of the slot sections. In more detail, as shown in FIG. 5, the $E_y$ components of the fields in the two slot sections will act to cancel one another while the E components (the field components essentially perpendicular to the respective slot sections) are directed toward the antenna aperture and aid one another when the slot sections curve away from each other. Also, the $E_x$ components move in the same direction toward the aperture adding to one another and radiating.

It is preferable that the substrate with the described antenna 10 be positioned within an enclosure 46 having a unitary bottom 48 and side walls 50. Specifically, the central portion 51 of the enclosure 46 consists of a non-absorbing material while the remainder of the enclosure 46 includes a body 53 constructed of an electromagnetic energy absorbing material (e.g., a synthetic thermoplastic material). Orientation of the antenna within the enclosure is such that the metal layer and slot sections face outwardly through the enclosure open top 52. The body 53 absorbs radiation and, in that way, prevent undesirable inward radiation and possible re-radiation.

Figure 2:
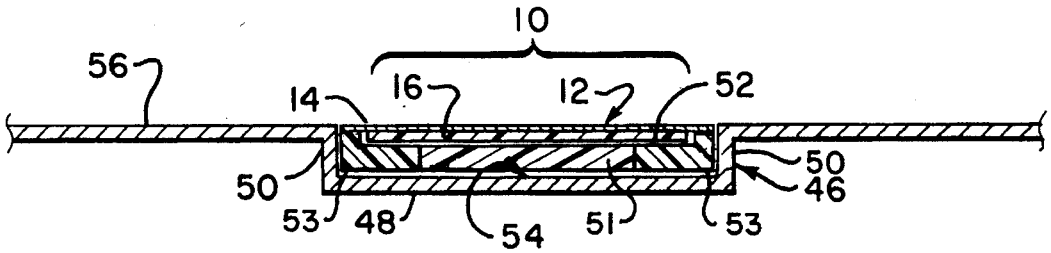
FIG. 2 is a side elevational, sectional view of the antenna of FIG. 1 showing it conformally mounted within a cavity.

An advantageous feature of the present invention is that it can be conformally mounted. As shown best in FIG. 2, the antenna 10 received within the enclosure 46 is located within a cavity 54 formed in the outer surface 56 of an aircraft, for example, with none of the antenna parts extending beyond the surface into the wind stream which is desirable from an aerodynamic standpoint.

Figure 6:
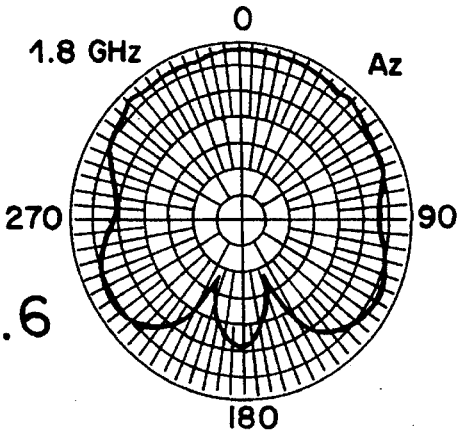
FIG. 6 depicts graphs of radiation patterns obtained for the described antenna.

The graph in FIG. 6 represents a radiation pattern obtained from test of a practical construction of the described antenna. During test running from which this graph was taken the antenna plane was oriented with the aperture directed toward 0 degrees and the polarization was such that the E field was orthogonal to the antenna plane.

In the practice of the present invention there is provided a receiving/transmitting antenna having a very low profile enabling conformal mounting such as within a cavity formed in the,outer surface of an aircraft, for example. A broad operating bandwidth is achieved exceeding that of the more conventional slot antennas, with actual tests showing 600% obtainable. Still further the antenna may be readily modified for either high directivity or omnidirectional use by narrowing or expanding the antenna aperture accordingly.

Figure 7:
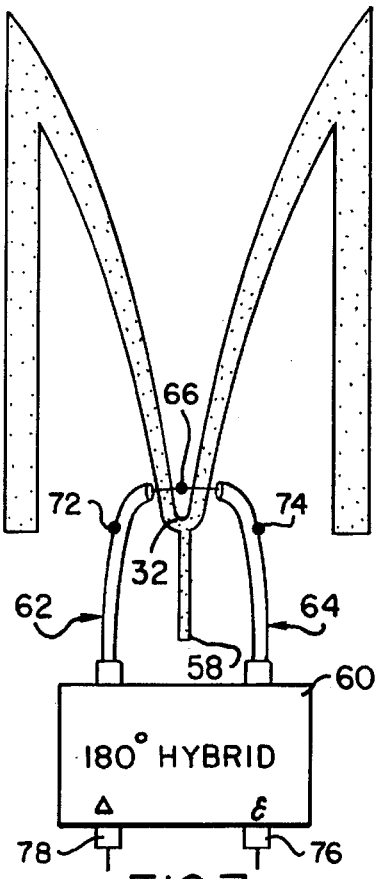
FIG. 7 is a schematic view of a modified feedwork network for the described antenna.
Figure 8:
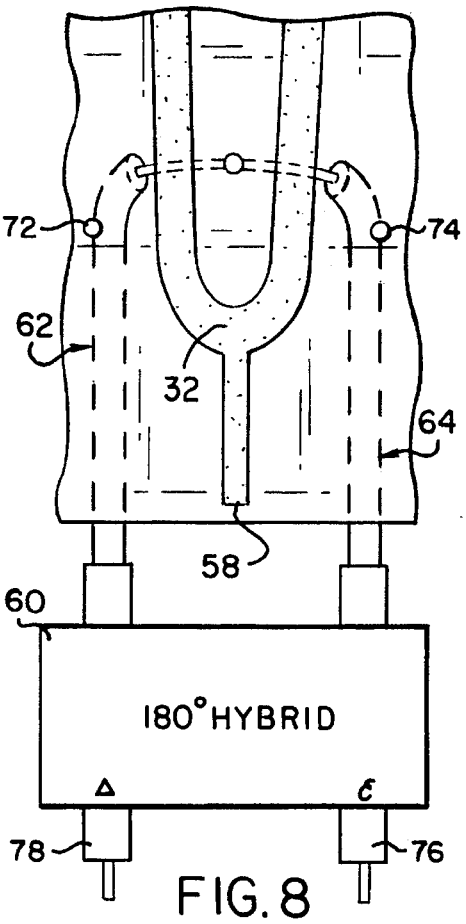
FIG. 8 is an enlarged plan view of feed connections of the FIG. 7 version.
Figure 9:
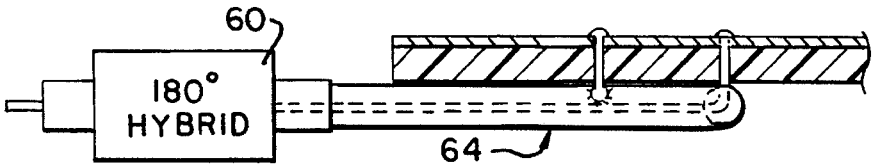
FIG. 9 is a sided elevational view taken along line 9—9 of FIG. 8.

For the ensuing description of a modified feed network for use with the described antenna, reference is made to FIGS. 7, 8 and 9. A section of slotline 58 is added to the linking slot 32 and extending away therefrom along a line generally aligned with the transition 24 which is necessary to obtain horizontal polarization. A 180° hybrid 60 is interconnected with the antenna 10 via first and second segments of transmission line 62 and 64, respectively, (e.g., coaxial cable). More particularly, the transmission line center conductors are connected together and with the metal layer 12 at 66 located between the slot segments closely adjacent where feed point 30 is located in the FIG. 3 version. The transmission line outer conductors respectively interconnect with layer 12 at points 72 and 74 just outsided the slot segments adjacent the feed point 30.

Figure 10A:
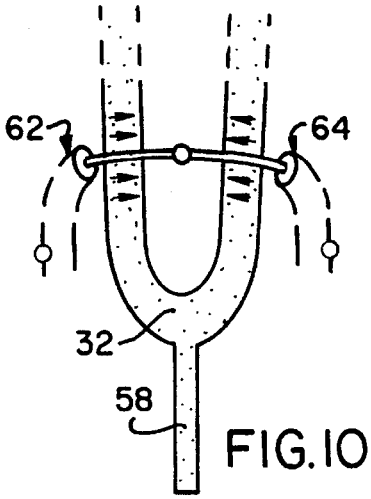
FIGS. 10A and 10B are schematic representations of antenna energization to produce vertically and horizontally polarized electromagnetic waves.
Figure 10B:
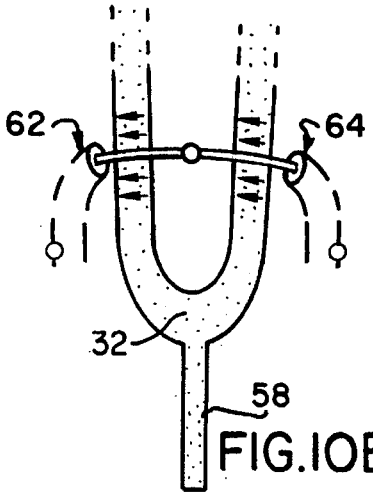

The 180° hybrid includes both sum (Σ) and difference (Δ) ports 76 and 78, respectively. FIG. 10A, for example, shows the summed signals which results in a vertically polarized antenna response. On the other hand, when energy is fed through the Δ hybrid port, the E field vectors excited on the two sides of the flared slots are oriented in the same direction providing a horizontally polarized antenna response.

When the described antenna is constructed and fed electromagnetic energy as in the version of FIGS. 7 through 9, an antenna is provided which can be flush mounted to the outer surface of a vehicle, operates over a wide frequency range, produces a moderately directive beam, and can simultaneously operate as a vertically polarized antenna and as a horizontally polarized antenna.

Although the invention has been described in connection with preferred embodiments, it is to be understood that those skilled in the appertaining arts may conceive of modifications that come within the spirit of the invention as described and the ambit of the appended claims.

What is claimed is:

1. A slot antenna, comprising:

a generally planar electrically conductive sheet having first and second major surfaces and edges;

a portion of the conductive sheet being removed to form a single slot, said slot including a pair of symmetrical slot sections having facing edges separated by a strip of said conductive sheet, and a linking portion of the slot interconnecting the two slot sections at a first end of each slot section;

said conductive sheet strip having a transition portion extending away from first ends of the slot sections where slot sections facing edges are substantially parallel to one another, and beyond the transition portion facing edges of the slot sections continuously curving away from each other to form a radiating aperture therebetween; and an electromagnetic energy absorbing body enclosing the electrically conductive sheet first major surface and edges while leaving the slot sections free on the sheet second major surface.

2. A slot antenna as in claim 1, in which the linking portion is an electromagnetic energy feed point when the antenna is operated in transmission mode; and means for interconnecting radio frequency electric power to the conductive sheet at points on opposite sides of the linking portion.

3. A slot antenna as in claim 2, in which said means includes a coaxial cable.

4. A slot antenna as in claim 1, in which each slot section has a transverse dimension that continuously increases from the first end to the aperture.

5. A slot antenna as in claim 1, in which a 180° hybrid having sum and difference ports has a pair of end connected transmission lines connected to the conductive sheet adjacent the linking slot for simultaneously providing horizontally polarized and vertically polarized signals.

6. A slot antenna as in claim 5, in which each transmission line includes an inner conductor surrounded by an outer conductor, the outer conductors of said transmission lines being respectively connected to the conductive sheet at opposite sides of the slot sections, and the inner conductors both connect to the conductive sheet intermediate the slot sections.

7. A slot antenna of low profile enabling conformal mounting, comprising:

an open-top thermoplastic enclosure having generally imperforate bottom and side walls;

a dielectric substrate received in the enclosure cavity with a substrate first major surface facing outwardly from the enclosure;

a copper layer deposited onto the substrate first major surface, parts of the copper layer being etched away to form a pair of slot sections with facing tapered edges separated a first amount at an electromagnetic energy feed point and a second greater amount at an aperture spaced from the feed point;

first and second slot portions respectively connected to the slot sections and extending in a direction away from the aperture; and an electrically resistive material applied to the first and second slot portions.

8. An antenna as in claim 7, in which radio frequency voltage is applied to the feed point during transmission mode to launch an electromagnetic wave at the aperture centered along an axis lying between the slot sections.

9. An antenna as in claim 8, in which the feed point includes a linking slot extending transversely of the axis interconnecting with each slot section; a coaxial power cable located at a second major surface of the substrate, the center conductor of which passes through an opening in the substrate to connect with the copper layer at a point between the slot sections, and the cable other conductor extends through a further opening in the substrate to connect with the copper layer at a point outwardly of the linking slot.

10. An antenna as in claim 7, in which a 180° hybrid having sum and difference ports has a pair of transmission lines connected to the copper layer adjacent the feed point for simultaneously providing horizontally polarized and vertically polarized signals.

11. A slot antenna as in claim 10, in which each transmission line includes an inner conductor surrounded by an outer conductor, the outer conductors of said transmission lines being respectively connected to the copper layer at opposite sides of the slot sections, and the inner conductors both connect to the copper layer intermediate the slot sections.

* * * * *